US008727473B2

(12) United States Patent
Calamita

(10) Patent No.: US 8,727,473 B2
(45) **Date of Patent: *May 20, 2014**

(54) METHOD AND SYSTEM FOR IDENTIFYING PRINTHEAD ROLL

(75) Inventor: James P. Calamita, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 400 days.

This patent is subject to a terminal disclaimer.

(21) Appl. No.: 13/222,338

(22) Filed: Aug. 31, 2011

(65) Prior Publication Data

US 2013/0050321 A1 Feb. 28, 2013

(51) Int. Cl.
*B41J 29/38* (2006.01)

(52) U.S. Cl.
USPC ..... 347/14

(58) Field of Classification Search
USPC ..... 347/19, 5, 14; 399/384
See application file for complete search history.

(56) References Cited

U.S. PATENT DOCUMENTS

| | | | | |
|---|---|---|---|---|
| 5,889,534 | A * | 3/1999 | Johnson et al. | 347/19 |
| 6,213,580 | B1 | 4/2001 | Segerstrom et al. | |
| 7,309,118 | B2 | 12/2007 | Mizes et al. | |
| 7,798,587 | B2 | 9/2010 | Mizes et al. | |
| 7,837,290 | B2 | 11/2010 | Mizes et al. | |
| 8,562,101 | B2 * | 10/2013 | Calamita et al. | 347/19 |
| 2005/0179710 | A1 * | 8/2005 | Tatsuta et al. | 347/5 |
| 2006/0132526 | A1 | 6/2006 | Donovan | |
| 2010/0013882 | A1 * | 1/2010 | Mizes et al. | 347/14 |
| 2010/0209160 | A1 * | 8/2010 | Mizes et al. | 399/384 |
| 2010/0245455 | A1 * | 9/2010 | Mizes et al. | 347/19 |

* cited by examiner

*Primary Examiner* — Alessandro Amari
*Assistant Examiner* — Carlos A Martinez
(74) *Attorney, Agent, or Firm* — Maginot, Moore & Beck, LLP

(57) ABSTRACT

A method for aligning a printhead to compensate for printhead roll has been developed. The method includes simultaneously operating a plurality of inkjets in a printhead to eject ink drops to form a plurality of marks on an image receiving member. A plurality of cross-process direction distances between one mark formed by a reference inkjet and each of the marks formed by the other inkjets is identified. A magnitude of a difference between an angular orientation of the printhead and the cross-process direction with reference to the plurality of identified cross-process direction distances indicates any printhead roll.

10 Claims, 5 Drawing Sheets

METHOD AND SYSTEM FOR IDENTIFYING PRINTHEAD ROLL

TECHNICAL FIELD

The present disclosure relates to imaging devices that utilize printheads to form images on media, and, in particular, to the alignment of such printheads in printers.

BACKGROUND

Ink jet printing involves ejecting ink droplets from orifices in a printhead onto an image receiving surface to form an ink image. Inkjet printers commonly utilize either direct printing or offset printing architecture. In a typical direct printing system, ink is ejected from the inkjets in the printhead directly onto the final substrate. In an offset printing system, the printhead jets the ink onto an intermediate transfer surface, such as a liquid layer on a drum. The final substrate is then brought into contact with the intermediate transfer surface and the ink image is transferred to the substrate before being fused or fixed to the substrate.

Alignment among multiple printheads may be expressed as the position of one printhead relative to the image receiving surface, such as a media substrate or intermediate transfer surface, or another printhead within a coordinate system of multiple axes. For purposes of discussion, the terms "cross-process direction" and "X-axis direction" refer to a direction or axis perpendicular to the direction of travel of an image receiving surface past a printhead. The terms "process direction" and "Y-axis direction" refer to a direction or axis parallel to the direction of an the image receiving surface, the term "Z-axis" refers to an axis perpendicular to the X-Y axis plane.

One particular type of alignment parameter is printhead roll. As used herein, printhead roll refers to clockwise or counterclockwise rotation of a printhead about an axis normal to the image receiving surface, i.e., Z-axis. Printhead roll may result from mechanical vibrations and other sources of disturbances on the machine components that may alter printhead positions and/or angles with respect to the image receiving surface. As a result of roll, the rows of nozzles may be arranged diagonally with respect to the process direction movement of the image receiving surface. This roll may cause horizontal lines, image edges, and the like to be skewed relative to the image receiving surface.

Various methods are known to measure printhead roll and to calibrate the printhead to reduce or eliminate the effects of printhead roll on images generated by the printhead. The known methods include printing selected marks or test patterns onto the image receiving member from the printhead to identify printhead roll. In some imaging systems, the image receiving member moves in the cross-process direction while the printhead generates the test pattern. Even comparatively small movements in the image receiving member can result in errors in printed test patterns that reduce the effectiveness of known methods for detecting printhead roll. Thus, improvements to printhead measurement and calibration procedures for detecting printhead roll are desirable.

SUMMARY

A method of aligning a printhead has been developed. The method includes operating a plurality of inkjets in a printhead to eject ink drops to form a plurality of marks on an image receiving member, each inkjet in the plurality of inkjets operating substantially simultaneously, generating image data of the plurality of marks on the image receiving member, identifying with reference to the generated image data a plurality of cross-process direction distances in a cross-process direction between a first mark formed by one inkjet in the plurality of inkjets and each mark formed by one of the other inkjets in the plurality of inkjets, and identifying a magnitude of a difference between an angular orientation of the printhead and the cross-process direction with reference to the plurality of identified cross-process direction distances.

In another embodiment, a printer that is configured to identify printhead roll is provided. The printer includes a printhead having a plurality of inkjets arranged in plurality of rows, each row extending in a cross-process direction and the plurality of rows extending in a process direction, each inkjet being configured to eject ink drops, an image receiving member configured to move in the process direction relative to the printhead, an optical sensor configured to generate image data corresponding to light reflected from the image receiving member at a plurality of locations in the cross-process direction, and a controller operatively connected to the printhead and optical sensor. The controller is configured to operate a first plurality of inkjets selected from the plurality of inkjets in the printhead to form a plurality of marks on the image receiving member, the controller operates each inkjet in the first plurality of inkjets substantially simultaneously, identify with reference to image data generated by the optical sensor of the plurality of marks on the image receiving member a plurality of cross-process direction distances between a first mark formed by one inkjet in the first plurality of inkjets on the image receiving member and a plurality of marks formed by the other inkjets in the first plurality of inkjets on the image receiving member, and identify a magnitude of a difference between an angular orientation of the printhead and the cross-process direction with reference to the plurality of identified cross-process direction distances.

In another embodiment, a method for detecting printhead roll has been developed. The method includes operating a first plurality of inkjets in a single printhead substantially simultaneously to eject ink drops onto an image receiving member, each inkjet in the first plurality of inkjets forming a plurality of dashes on the image receiving member, generating image data of the plurality of dashes formed by each of the first plurality of inkjets on the image receiving member with an optical sensor, identifying with reference to the image data an average distance in a cross-process direction between a first plurality of dashes formed by one of the plurality of inkjets and each plurality of dashes formed by one of the other inkjets in the plurality of inkjets, and identifying a magnitude of a difference between an angular orientation of the single printhead and the cross-process direction with reference to the plurality of identified cross-process direction distances.

BRIEF DESCRIPTION OF THE DRAWINGS

The foregoing aspects and other features of a printer that detects and compensates for roll in one or more printheads in the printer are explained in the following description, taken in connection with the accompanying drawings.

DETAILED DESCRIPTION

Figure 1A:
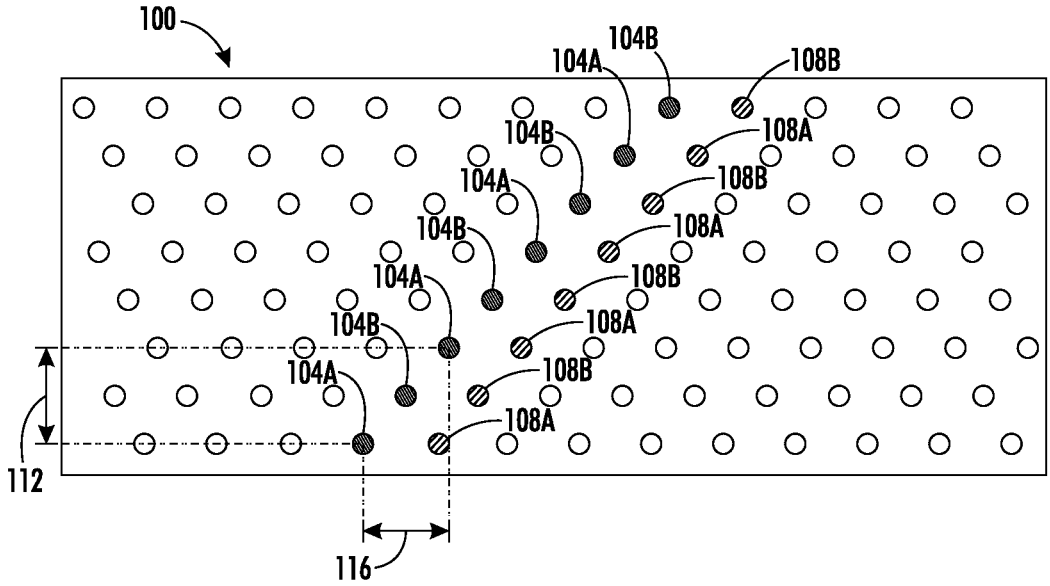
FIG. 1A is a view of a printhead with a plurality of inkjets aligned with a cross-process direction.

For a general understanding of the present embodiments, reference is made to the drawings. In the drawings, like reference numerals have been used throughout to designate like elements. As used herein, the terms "printer" generally refer to an apparatus that applies an ink image to print media and may encompass any apparatus, such as a digital copier, bookmaking machine, facsimile machine, multi-function machine, etc., which performs a print outputting function for any purpose. As used in this document, "ink" refers to a colorant that is liquid when applied to an image receiving member. For example, ink may be aqueous ink, ink emulsions, melted phase change ink, and gel ink that has been heated to a temperature that enables the ink to be liquid for application or ejection onto an image receiving member and then return to a gelatinous state. "Print media" can be a physical sheet of paper, plastic, or other suitable physical substrate suitable for receiving ink images, whether precut or web fed. A printer may include a variety of other components, such as finishers, paper feeders, and the like, and may be embodied as a copier, printer, or a multifunction machine. An ink image generally may include information in electronic form, which is to be rendered on print media by a marking engine and may include text, graphics, pictures, and the like.

The term "printhead" as used herein refers to a component in the printer that is configured to eject ink drops onto the image receiving member. A typical printhead includes a plurality of inkjets, also referred to as ink ejectors, that are configured to eject ink drops of one or more ink colors onto the image receiving member. The inkjets are arranged in an array of one or more rows and columns. In some embodiments, the inkjets are arranged in staggered diagonal rows across a face of the printhead. Various printer embodiments include one or more printheads that form ink images on the image receiving member.

FIG. 1A depicts a printhead 100 including a plurality of inkjets exemplified by inkjets 104A-104B and 108A-108B. The inkjets are formed in a plurality of staggered rows, with FIG. 1 including eight rows. The inkjets can be grouped diagonally as depicted with inkjets 104A and 104B staggered along a single diagonal and inkjets 108A and 108B staggered along a parallel diagonal. In one configuration, each inkjet in the printhead 100 is configured to eject ink having a single color onto an image receiving member. In another configuration, the printhead 100 is a multi-color printhead where selected groups of inkjets emit ink drops having different colors of ink. In one configuration of a multi-color printhead, the inkjets 104A-104B eject ink having one color and the inkjets 208A-208B eject ink having a different color. As depicted in more detail below, the inkjets in each of the depicted groups 104A-104B and 108A-108B are operated simultaneously to form marks on an image receiving member.

The inkjets arranged along each diagonal are separated from each other by a predetermined distance in the process direction and another predetermined distance in the cross-process direction. For example, each pair of inkjets 104A are separated by a process direction distance 112, and a cross-process direction distance 116. The structure of the printhead 100 and density of the inkjets in the printhead determine the cross-process and process direction distances between the inkjets. In the embodiment of the printhead 100, all of the inkjets are formed with uniform separation in the process direction and cross-process direction between the inkjets.

Figure 1B:
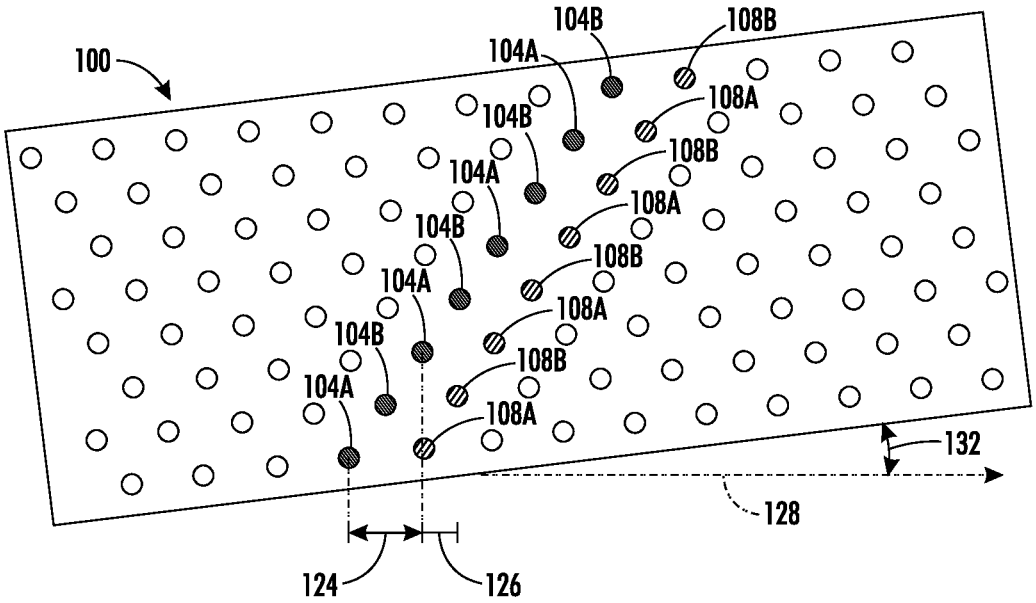
FIG. 1B is a view of the printhead of FIG. 1A with an angular offset from the cross-process direction.

FIG. 1B depicts the printhead 100 of FIG. 1A with an angular orientation that deviates from the cross-process direction. In the configuration of FIG. 1B, the printhead 100 is said to have a printhead roll. The printhead roll is depicted by an angle of rotation 132 between the printhead 100 and the cross-process direction 128. The magnitude of the angle 132 is typically measured in degrees or radians. The direction of the angle 132 refers to whether the printhead 100 rolls in a clockwise or counter-clockwise direction, which can also be expressed as positive or negative values of the sign of the angle 132.

In FIG. 1B, the printhead 100 rotates in a counter-clockwise direction. The cross-process direction distance between inkjets in the orientation of FIG. 1B is depicted by distance 124. A second distance 126 depicts a difference between the cross-process distance 124 and the nominal cross-process distance 116 between the same inkjets 104A when the printhead 100 is aligned with the cross-process direction 128. In the configuration of FIG. 1B, the cross-process distance 124 is smaller than the predetermined cross-process distance 116 of the aligned printhead. In orientations where the printhead 100 experiences roll in a clockwise direction, the cross-process distance between corresponding inkjets is larger than the predetermined distance 116. As described in more detail below, both the magnitude and direction of the printhead roll are identified with reference to the measured cross-process distance between two or more inkjets compared to the predetermined cross-process distance between the inkjets when the printhead is aligned with the cross-process direction.

The magnitude of the printhead roll depicted in FIG. 1B is exaggerated for illustrative purposes. In a typical printer embodiment, the printhead roll is on the order of approximately 0.001 to 0.01 radians. The printhead 100 is depicted with a comparatively low resolution and small number of inkjets to simplify the drawings. Typical alternative printheads include hundreds or thousands of ink ejectors that are arranged to form a continuous line having at least several hundred drops per inch in the cross-process direction. The systems and method described herein are suitable for identifying and correcting printhead roll over a wide range of angular displacements and printhead resolutions.

Figure 2:
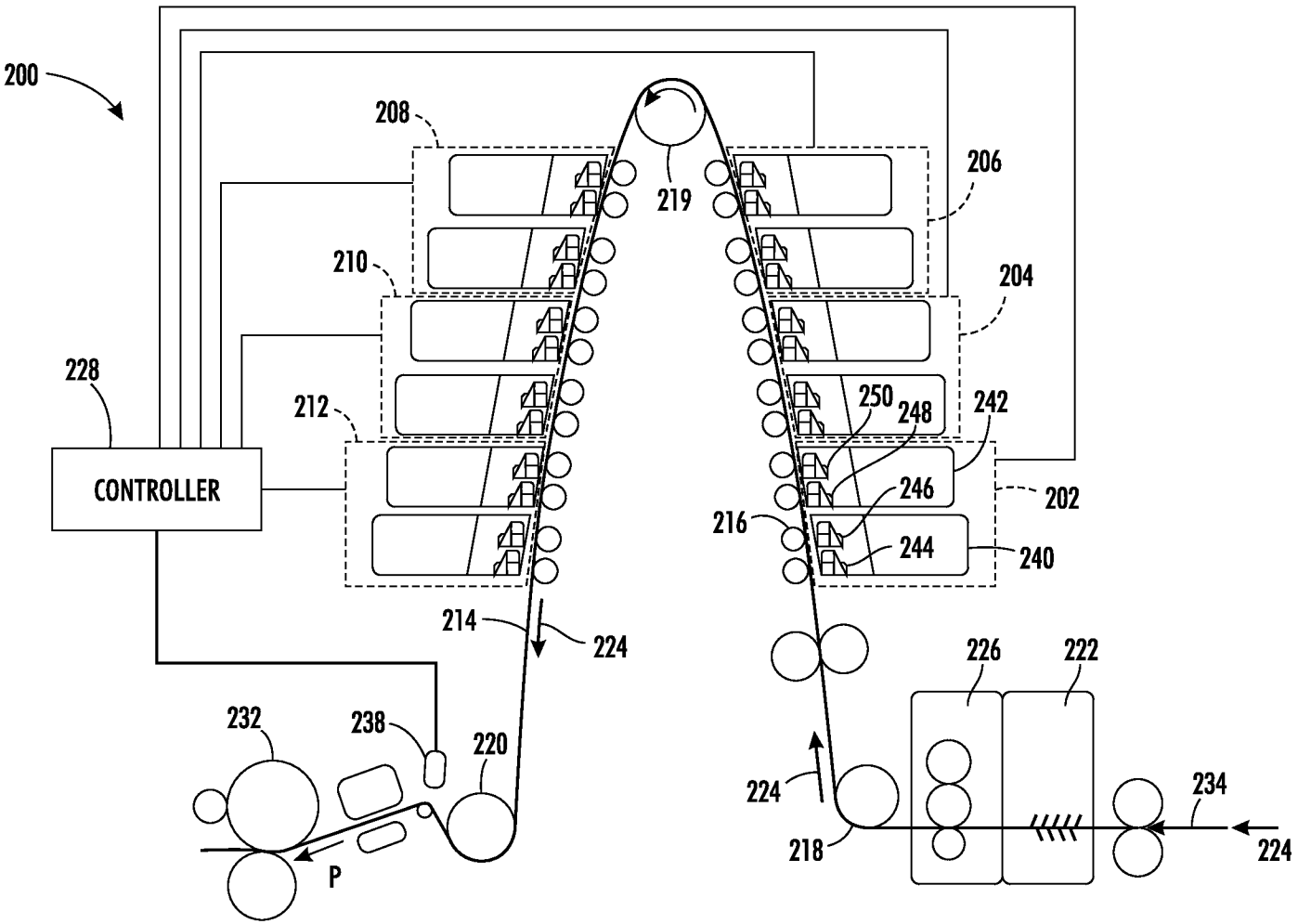
FIG. 2 is a schematic view of a test pattern formed by the printhead of FIG. 1A-FIG. 1B on a media web.

FIG. 2 depicts an exemplary embodiment of a printer 200 that is configured to identify and correct printhead roll. Printer 200 is a continuous web printer that includes six print modules 202, 204, 206, 208, 210, and 212; a media path 224 configured to accept a print medium 214, and a controller 228. The print modules 202, 204, 206, 208, 210, and 212 are positioned sequentially along a media path 224 and form a print zone in which ink images are formed on a print medium 214 as the print medium 214 moves past the print modules.

In printer 200, each print module 202, 204, 206, 208, 210, and 212 in this embodiment provides an ink of a different color. In all other respects, the print modules 202-212 are substantially identical. Print module 202 includes two print sub-modules 240 and 242. Print sub-module 240 includes two print units 244 and 246. The print units 244 and 246 each include an array of printheads that may be arranged in a staggered configuration across the width of both the first section of web media and second section of web media. Each of the printheads includes a plurality of inkjets in a configuration similar to the printhead 200 depicted in FIG. 2. In a typical embodiment, print unit 244 has four printheads and print unit 246 has three printheads. The printheads in print units 244 and 246 are positioned in a staggered arrangement to enable the printheads in both units to emit ink drops in a continuous line across the width of media path 224 at a predetermined resolution.

Print sub-module 242 is configured in a substantially identical manner to sub-module 240, but the printheads in sub-module 242 are offset by one-half the distance between the inkjets in the cross-process direction from the printheads in sub-module 240. The arrangement of sub-modules 240 and 242 enables a doubling of linear resolution for images formed on the media web 214. For example, if each of the sub-modules 240 and 242 ejects ink drops at a resolution of 300 drops per inch, the combination of sub-modules 240 and 242 ejects ink drops at a resolution of 600 drops per inch.

The printer 200 includes an optical sensor 238 that generates image data corresponding to light reflected from the media web 214 after the media web 214 has passed through the print zone. The optical sensor 238 is configured to detect, for example, the location, intensity, and/or location of ink drops jetted onto the receiving member by the inkjets of the printhead assembly. The optical sensor 238 includes an array of optical detectors mounted to a bar or other longitudinal structure that extends across the width of the media web 214 in the cross-process direction.

In one embodiment in which the media web 214 is approximately twenty inches wide in the cross process direction and the print modules 202-212 print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors are arranged in the optical sensor 238 in a predetermined configuration in the cross-process direction. Consequently, the cross-process position of light reflected from the media web 214 can be identified with reference to the optical detector that detects the reflected light. For example, if two optical detectors in the optical sensor 238 detect light reflected from two different ink drops on the media web 214, then the predetermined distance that separates the optical detectors in the optical sensor 238 corresponds to the cross-process distance between the two ink drops on the media web 214.

The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. The magnitudes of the electrical signals generated by the optical detectors are converted to digital values by an appropriate analog/digital converter. The digital values are denoted as image data in this document and a processing device, such as controller 228 executing programmed instructions, analyzes the image data to identify positional information about dashes formed by ink drops on the image receiving member.

During operation, the media web 214 moves through the media path in process direction 224. The media web 214 unrolls from a source roller 252 and passes through a brush cleaner 222 and a contact roller 226 prior to entering the print zone. The media web 214 moves through the print zone past the print modules 202-212 guided by a pre-heater roller 218, backer rollers, exemplified by backer roller 216, apex roller 219, and leveler roller 220. The media web 214 then passes through a heater 230 and a spreader 232 after passing through the print zone. The media web passes an exit guide roller 234 and then winds onto a take-up roller 254. The media path 224 depicted in FIG. 1 is exemplary of one media path configuration in a web printing system, but various different configurations may lead the web past different rollers and other components. Alternative media path configurations include a duplexing unit that enables the printer 200 to form ink images on both sides of the media web 214.

The media web 214 may experience oscillations in the cross-process direction as the media web moves through the printer 200. During a printing operation, the web 214 oscillates on the backer rollers 216 when moving past the print modules 202-212 in the print zone. In one configuration, the media web oscillates in the process direction with a frequency of approximately 8 Hz and a magnitude of 30 microns. The oscillations can reduce the accuracy of absolute positional measurements made with reference to the image data generated by the optical sensor 238 because the optical sensor 238 remains stationary while the media web 214 oscillates.

Controller 228 is configured to control various subsystems, components and functions of printer 200. The controller 228 is operatively connected to each of the printheads in the print modules 202-212 to control ejection of ink from each of the print modules 202-212. The controller 228 is also connected to optical sensor 238 and the controller 228 receives image data that the optical sensor 238 generates from light reflected from the media web 214.

In various embodiments, controller 228 is implemented with general or specialized programmable processors that execute programmed instructions. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Controller 228 is operatively coupled to the print modules 202-222 and controls the timing of ink drop ejection from the print modules 202-212 onto the media web 214. The controller 228 generates a plurality of electrical firing signals for the inkjets in each of the print modules 202-212. The controller 228 is configured to generate a predetermined sequence of firing signals for each of the printheads in the print modules 202-212 to generate test pattern ink marks on the media web 214. As used herein, the term "test pattern" refers to any set of ink marks formed with ink drops on an image receiving member that are used to calibrate one or more printer components. Various configurations of test patterns formed on the media web 214 enable the controller 228 to identify printhead roll of the printheads in the print modules 202-212.

Figure 3:
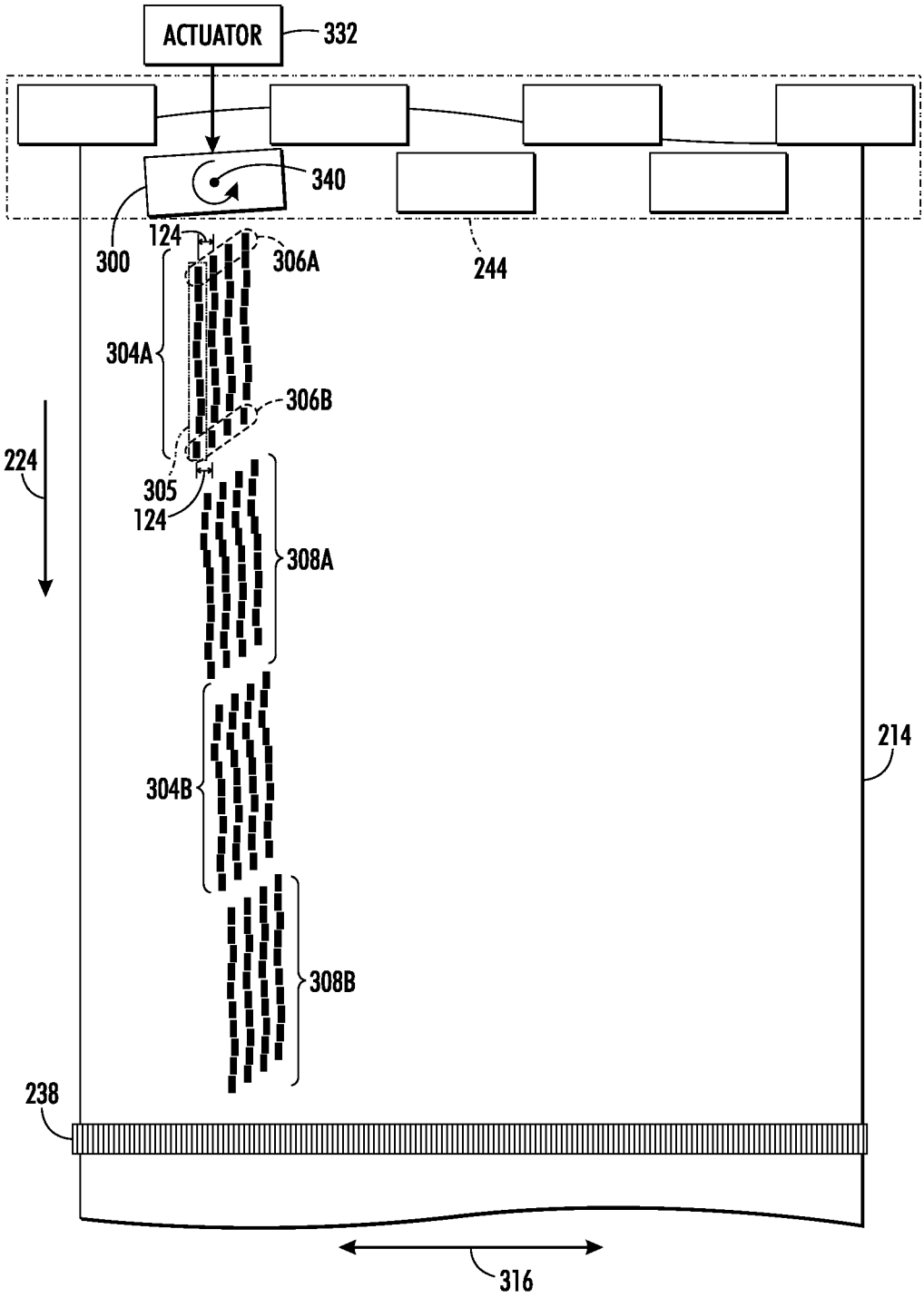
FIG. 3 is a schematic diagram of an exemplary printer embodiment that is configured to identify and correct printhead roll for a plurality of printheads in the printer.

FIG. 3 depicts a schematic view of one of the print sub-modules 242 from the printer 200 that is configured to form a series of marks 304A-304B and 308A-308B on the media web 214. The print sub-module 242 includes seven printheads including a printhead 300. The printhead 300 is depicted with a roll error rotation about an axis 340 that is perpendicular to the surface of the media web 214. For purposes of illustration, the printhead 300 includes the same configuration of inkjets depicted in the printhead 100 of FIG. 1A and FIG. 1B.

The media web 214 moves in a process direction 224 past the printhead 300 as the printhead 300 forms the test pattern. The marks 304A-304B and 308A-308B are formed by ink drops ejected from selected inkjets in the printhead 300. Each set of marks includes a plurality of dashes where each dash is formed by a single inkjet ejecting ink drops in rapid succession onto the media web 114. The marks 204A, 208A, 204B, and 208B are formed by inkjets 104A, 108A, 104B, and 108B, respectively, in the printhead 300. In the example of FIG. 3, each group of inkjets forms a series of ten dashes, although alternative test patterns include different patterns of marks. The inkjets form each corresponding set of dashes simultaneously. Since the inkjet groups are arranged diagonally in the printhead 300, each set of dashes is arranged in a corresponding diagonal pattern on the image receiving member 214.

In FIG. 3, the media web 214 oscillates in the cross-process direction 316. The oscillation results in cross-process variations in the positions of dashes formed on the image receiving member 214. However, the relative cross-process direction distances between dashes in each set of dashes formed by one of the inkjet groups 104A-104B and 108A-108B remain substantially unaffected by the oscillation of the media web 214. Since each corresponding group of inkjets forms corresponding dashes simultaneously, the oscillation of the media web 214 over time does not change the cross-process direction distances between the corresponding dashes. Dashes formed from a selected reference inkjet in each of the inkjet groups 104A-104B and 108A-108B form a reference line from which the cross-process distance of the other ink marks are measured.

In the marks 304A, the first set of dashes 306A and the last set of dashes 306B are offset from each other in the cross-process direction 316 due to oscillation of the media web 214. However, the same cross-process distance 124 separates two corresponding dashes in each set of dashes 306A and 306B. The measured cross-process distance of the dashes corresponds to the cross-process distance between the inkjets in the printhead 300. Using one dash in each set of dashes as a reference, the cross-process distance that separates the reference dash from each of the other dashes is affected by the roll of the printhead 300, but not by the cross-process direction oscillation of the media web 214.

Figure 4:
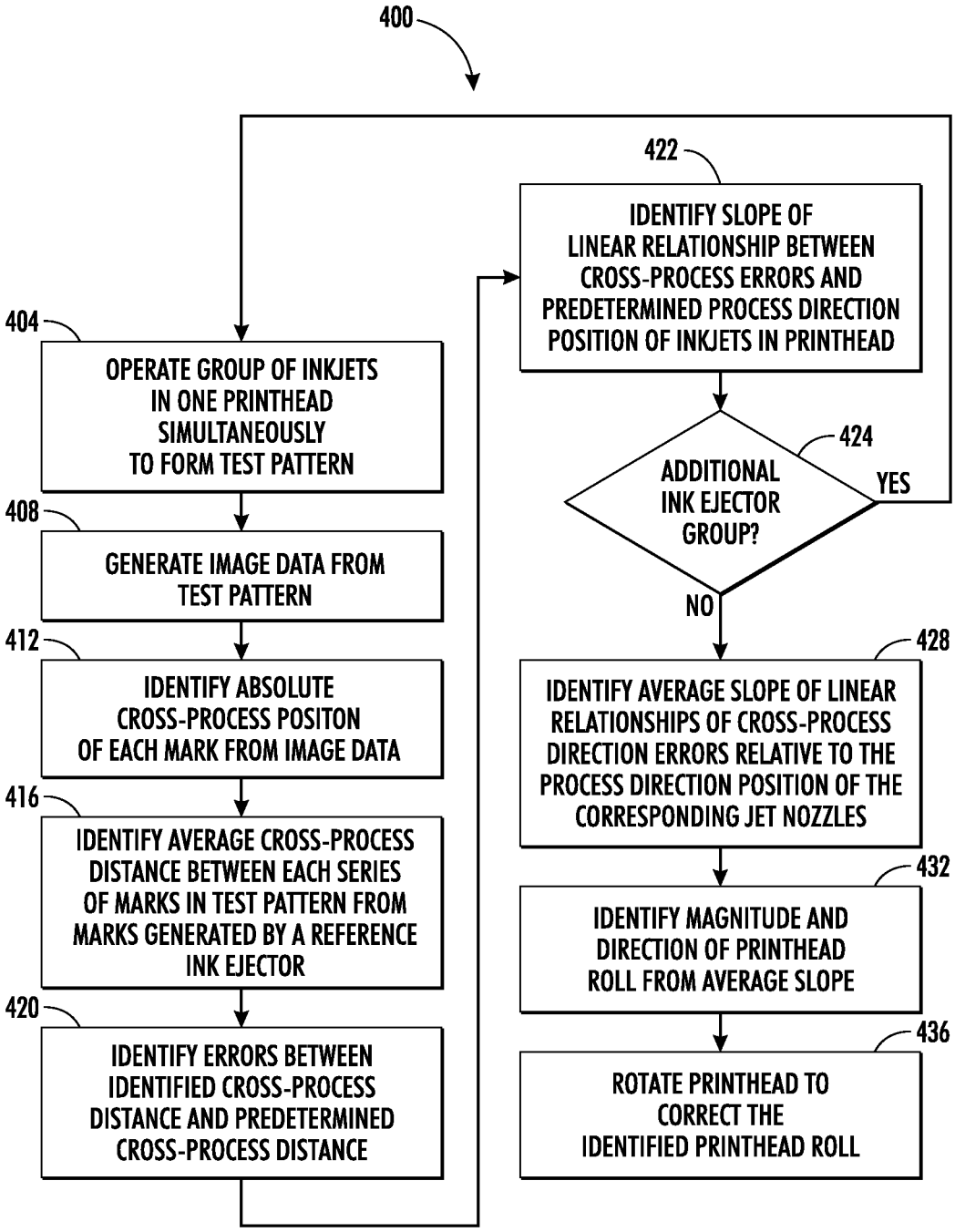
FIG. 4 is a block diagram of a process for identifying an angular offset of a printhead from the cross-process direction.

FIG. 4 depicts a process 400 for identifying printhead roll. The printer 200 and printhead 100 of FIG. 1A-FIG. 3 are referenced for purposes of illustrating the process 400. Process 400 begins by operating a plurality of inkjets simultaneously to form a test pattern on an image receiving member (block 404). In the printer 200, the controller 228 generates a plurality of electrical firing signals that operate a selected group of inkjets simultaneously. Using the printhead 300 as an example, the inkjets 104A each receive a series of firing signals substantially simultaneously. The inkjets 104A eject ink drops onto the media web 214. The controller 228 is configured to generate a predetermined series of firing signals, and in the example of the printer 200, each of the inkjets 104A in the printhead 300 generates a series of ten dashes in a test pattern 304A.

Process 400 generates image data from the test pattern formed on the image receiving member (block 408). In the printer 200, the optical sensor 238 generates image data corresponding to each of the dashes in the test pattern 304A. The controller 228 receives the image data from the optical sensor 238 and identifies the absolute cross-process position of each dash in the test pattern 304A (block 412). Each dash includes a plurality of ink drops, and the absolute cross-process position of each dash is an average of the cross-process directions of each drop to reduce the effects of transient inkjet errors in the image data.

As described above, the absolute cross-process position of the dashes on the image receiving member is subject to change due to the oscillation of the image receiving member. Process 400 identifies an average cross-process direction distance that separates each set of marks in the test pattern using the marks generated by a single ink ejector as a reference (block 416). In FIG. 3, the series of dashes 305 generated by one of the inkjets 104A serve as a reference. In each set of dashes such as set 306A, the controller 228 identifies a cross-process distance between the reference dash 305 and each of the other dashes in the set, such as cross-process distance 124. In the embodiment of FIG. 3, the controller 228 averages the cross-process distances between each series of dashes over the ten dashes in the test pattern 304A. Thus, while the absolute position of the dashes changes over time due to oscillation of the media web 214, process 400 identifies the relative cross-process distance only between sets of marks that are formed simultaneously.

Process 400 identifies errors between the identified cross-process distance separating marks in the test pattern and a predetermined expected cross-process distance between ink ejectors in the printhead when the printhead is aligned with the cross-process direction (block 420). FIG. 1B depicts an error distance 126 between two inkjets in a printhead 100 that experiences roll error. In process 400, the controller 228 identifies the error as a difference between a predetermined distance 116 between a reference inkjet and another one of the inkjets and the measured distance 124. In the test pattern 304A, four inkjets generate test pattern marks. The magnitude of the error increases in a linear manner as the separation between inkjets increases in the cross-process direction. While FIG. 3 depicts four series of marks in the test pattern 304A, alternative embodiments measure the errors between two or more series of test patterns marks.

Figure 5:
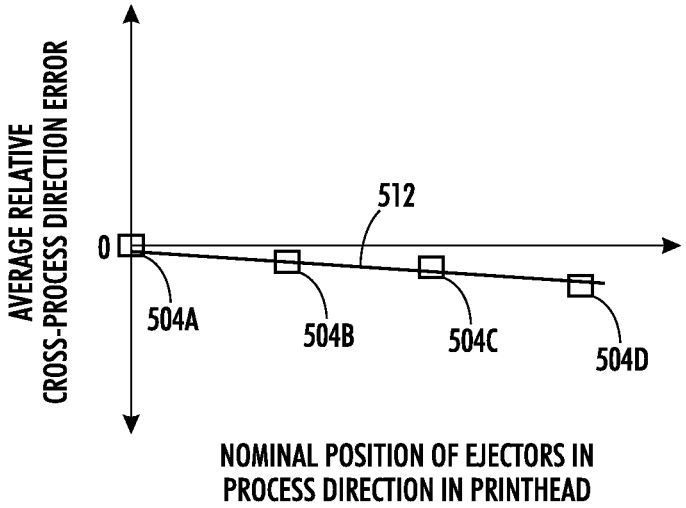
FIG. 5 is a graph depicting identified cross-process errors for test patterns formed by inkjets in the printhead compared to the process-direction positions of the inkjets.

Process 400 identifies a slope of a linear relationship between the identified cross-process errors between marks on the image receiving member and the predetermined process direction distances between inkjets in the printhead (block 422). FIG. 5 depicts a graph of relative errors 504A-504D graphed against the predetermined separation of inkjets in the process direction of the printhead. The relative error 504A represents the errors of marks generated by the reference inkjet and has zero relative error, while the errors of each of the other series of dashes increase as the process direction distance between the inkjets increases. In the printer 200, the controller 228 generates a linear curve fit of the relative errors 504A-504B, depicted by line 512 in FIG. 5. The sign of each error is based on whether the measured cross-process distance between marks is larger or smaller than the predetermined cross-process distance between the inkjets. In the configuration of FIG. 5, a positive error value indicates inkjets that are farther apart than the predetermined distance, and a negative value indicates inkjets are closer together than the predetermined distance. The slope of the line 512 provides information that is used to determine the magnitude and direction of the printhead roll.

Process 400 continues for any additional sets of inkjets in the printhead (block 424). In the example of printer 200, the printhead 300 ejects a total of four test pattern groups 304A, 308A, 304B, and 308B corresponding to the selected inkjet groups 104A, 108A, 104B, and 108B, respectively. The cross-process direction error data and corresponding linear relationships generated for each of the test pattern groups is sufficient to generate a measurement of the roll of the printhead 300. Process 400 averages the identified slopes of the linear relationships between cross-process errors and process direction positions of the corresponding inkjet nozzles generated for each test pattern group to provide a more accurate averaged printhead roll measurement (block 428). The printer 200 ejects four test pattern groups in example of FIG. 3, but alternative configurations of the process 400 form one or more test patterns as described above to measure the printhead roll.

Process 400 identifies the magnitude and angular direction of the printhead roll from the average slope of the linear relationships generated for the measured errors in each printhead (block 432). The magnitude of the roll error angle θ is identified with the equation θ=arctan(m) where m is the identified average slope of the relationship between the measured cross-process direction error between two inkjets and the nominal process direction separation between the inkjets. Intuitively, the slope of the error line can be thought of as an angle of deviation from the diagonal slope of the inkjet groups 104A, 104B, 108A, and 108B depicted in FIG. 1A.

Process 400 identifies the direction of the rotation based on the direction of the average measured errors, which also corresponds the sign of the average slope. In the example of FIG. 3, the printhead rolls in a counter-clockwise direction that reduces the measured cross-process distance between the selected inkjets, while a clockwise printhead roll would increase the cross-process distance between the selected inkjets. Thus, the direction of errors, indicating either an increased or decreased distance between inkjets in the printhead, identifies the direction of the printhead roll. Since the sign of the slope of the linear error relationship 512 is generated based on the direction of the errors, a positive or negative sign of the slope indicates the direction of the printhead roll. The selected arrangement of inkjets in the printhead determines whether increases or decreases in the cross-process distance between inkjets indicate clockwise or counter-clockwise rotation of the printhead.

Process 400 rotates the printhead to compensate for the identified angle and direction of the printhead roll (block 436). FIG. 3 depicts an actuator 332 that is operatively coupled to the printhead 300 and is controlled by the controller 228 of FIG. 2. The actuator 332 rotates the printhead 300 around the axis 340 by an angle that corresponds to the identified magnitude of printhead roll, and in the opposite direction of the identified direction of printhead roll. In some embodiments the actuator 332 is an electric stepper motor. In operation, a printing system such as printer 200 performs the process 400 periodically to identify and correct printhead roll for each printhead in the printing system.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art, which are also intended to be encompassed by the following claims.

I claim:

1. A method of aligning a printhead comprising:

operating a plurality of inkjets in a printhead to eject ink drops to form a plurality of marks on an image receiving member, each inkjet in the plurality of inkjets operating substantially simultaneously;

generating image data of the plurality of marks on the image receiving member;

identifying with reference to the generated image data a plurality of cross-process direction distances in a cross-process direction between a first mark formed by one inkjet in the plurality of inkjets and each mark formed by one of the other inkjets in the plurality of inkjets;

identifying a magnitude of a difference between an angular orientation of the printhead and the cross-process direction with reference to the plurality of identified cross-process direction distances;

identifying the magnitude of the difference between the angular orientation of the printhead and the cross-process direction with reference to a difference between the plurality of identified cross-process direction distances, a corresponding plurality of predetermined cross-process direction distances between the one inkjet and each of the other inkjets in the plurality of inkjets, and corresponding plurality of predetermined process direction distances between the one inkjet and each of the other inkjets in the plurality of inkjets;

identifying a first rotational direction of the difference between the angular orientation of the printhead and the cross-process direction in response to the plurality of identified cross-process direction distances being greater than the plurality of predetermined cross-process direction distances; and identifying a second rotational direction of the difference between the angular orientation of the printhead and the cross-process direction in response to the plurality of identified cross-process direction distances being less than the plurality of predetermined cross-process direction distances.

2. The method of claim 1 further comprising:

operating each inkjet in the plurality of inkjets to form marks that include a plurality of dashes, each plurality of dashes being formed by a single inkjet and arranged in the process direction on the image receiving member;

identifying an average cross-process distance between dashes in a first plurality of dashes formed by one inkjet in the plurality of inkjets and corresponding dashes in each of the other plurality of dashes formed by the other inkjets in the plurality of inkjets, the corresponding dashes being formed substantially simultaneously.

3. The method of claim 1 further comprising:

operating a second plurality of inkjets in the printhead to eject ink drops to form a second plurality of marks on the image receiving member, the second plurality of inkjets being different than the plurality of inkjets, each inkjet in the second plurality of inkjets operating substantially simultaneously;

generating image data of the second plurality of marks on the image receiving member;

identifying with reference to the image data of the second plurality of marks on the image receiving member a second plurality of cross-process direction distances in the cross-process direction between a second mark formed by one inkjet in the second plurality of inkjets and each mark formed by one of the other inkjets in the second plurality of inkjets; and identifying the magnitude of a difference between the angular orientation of the printhead and the cross-process direction with reference to the plurality of identified cross-process distances and the second plurality of identified cross-process distances.

4. The method of claim 3, the plurality of inkjets ejecting ink drops with an ink having a first color and the second plurality of inkjets ejecting ink drops with another ink having a second color.

5. The method of claim 1 further comprising:

rotating the printhead about an axis that is perpendicular to the image receiving member with an actuator, the rotation of the printhead being made with reference to the identified magnitude and rotational direction of the difference between the angular orientation of the printhead and the cross-process direction.

6. A printer comprising:

a printhead having a plurality of inkjets arranged in plurality of rows, each row extending in a cross-process direction and the plurality of rows extending in a process direction, each inkjet being configured to eject ink drops;

an image receiving member configured to move in the process direction relative to the printhead;

an optical sensor configured to generate image data corresponding to light reflected from the image receiving member at a plurality of locations in the cross-process direction; and a controller operatively connected to the printhead and optical sensor, the controller being configured to:

operate a first plurality of inkjets selected from the plurality of inkjets in the printhead to form a plurality of marks on the image receiving member, the controller operating each inkjet in the first plurality of inkjets substantially simultaneously;

identify with reference to image data generated by the optical sensor of the plurality of marks on the image receiving member a plurality of cross-process direction distances between a first mark formed by one inkjet in the first plurality of inkjets on the image receiving member and a plurality of marks formed by the other inkjets in the first plurality of inkjets on the image receiving member;

identify a magnitude of a difference between an angular orientation of the printhead and the cross-process direction with reference to the plurality of identified cross-process direction distances;

identify the magnitude of the difference between the angular orientation of the printhead and the cross-process direction with reference to a difference between the plurality of identified cross-process direction distances, a corresponding plurality of predetermined cross-process direction distances between the one inkjet and each of the other inkjets in the plurality of inkjets, and corresponding plurality of predetermined process direction distances between the one inkjet and each of the other inkjets in the plurality of inkjets;

identify a first rotational direction of the difference between the angular orientation of the printhead and the cross-process direction in response to the plurality of identified cross-process direction distances being greater than the plurality of predetermined cross-process direction distances; and identify a second rotational direction of the difference between the angular orientation of the printhead and the cross-process direction in response to the plurality of identified cross-process direction distances being less than the plurality of predetermined cross-process direction distances.

7. The printer of claim 6, the controller being further configured to:

operate each inkjet in the first plurality of inkjets to form marks that include a plurality of dashes, each plurality of dashes being formed by a single inkjet and arranged in the process direction on the image receiving member;

identify with reference data generated by the optical sensor of each plurality of dashes an average cross-process distance between dashes in a first plurality of dashes formed by one inkjet in the first plurality of inkjets and corresponding dashes in each of the other plurality of dashes formed by the other inkjets in the first plurality of inkjets, the corresponding dashes being formed substantially simultaneously.

8. The printer of claim 6, the controller being further configured to:

operate a second plurality of inkjets selected from the plurality of inkjets in the printhead to eject ink drops to form a second plurality of marks on the image receiving member, the second plurality of inkjets being different than the first plurality of inkjets, the controller operating each inkjet in the second plurality of inkjets substantially simultaneously;

identify with reference to image data generated by the optical sensor of the second plurality of marks on the image receiving member a second plurality of cross-process direction distances in the cross-process direction between a second mark formed by one inkjet in the second plurality of inkjets and each mark formed by one of the other inkjets in the second plurality of inkjets; and identify the magnitude of the difference between the angular orientation of the printhead and the cross-process direction with reference to the plurality of identified cross-process distances and the second plurality of identified cross-process distances.

9. The system of claim 8, the first plurality of inkjets ejecting ink drops with an ink having a first color and the second plurality of inkjets ejecting ink drops with another ink having a second color.

10. The printer of claim 6 further comprising:

an actuator configured to rotate the printhead about an axis that is perpendicular to the image receiving member; and the controller being operatively connected to the actuator and further configured to:

operate the actuator to rotate the printhead with reference to the identified magnitude and rotational direction of the difference between the angular orientation of the printhead and the cross-process direction.

* * * * *